US005595528A

United States Patent [19]

Becker

[11] Patent Number: 5,595,528

[45] Date of Patent: Jan. 21, 1997

[54] GRINDING WHEEL DRESSER

[75] Inventor: Edward Becker, Springfield, Vt.

[73] Assignee: Vermont Rebuild, Inc., Springfield, Vt.

[21] Appl. No.: 326,085

[22] Filed: Oct. 19, 1994

[51] Int. Cl.[6] ..... B24B 53/07

[52] U.S. Cl. ..... 451/72; 451/443; 125/11.03

[58] Field of Search ..... 451/72, 56, 21, 451/7, 147, 443; 125/11.03, 11.01, 11.04, 11.23

[56] References Cited

U.S. PATENT DOCUMENTS

| | | | |
|---|---|---|---|
| 4,112,624 | 9/1978 | Uhtenwoldt et al. | 451/72 |
| 4,266,377 | 5/1981 | Kikuchi et al. | 451/443 |
| 4,404,774 | 9/1983 | Sadao | 451/72 |
| 4,897,064 | 2/1990 | Vetter | 125/11.03 |

FOREIGN PATENT DOCUMENTS

| | | | |
|---|---|---|---|
| 0218555 | 8/1990 | Japan | 125/11.01 |
| 0194580 | 3/1967 | U.S.S.R. | 125/11.03 |
| 0502123 | 3/1939 | United Kingdom | 125/11.01 |

*Primary Examiner*—Robert A. Rose
*Attorney, Agent, or Firm*—DeLio & Peterson

[57] ABSTRACT

A dresser to be mounted on a grinding machine uses a ring-shaped dressing wheel approximately coaxially mounted with the workpiece axis around the tailstock to position the dresser contact region between the grinding wheel axis and the workpiece axis on the same side of the grinding wheel as the workpiece. Errors in the final size of the grinding wheel after being dressed due to thermal expansion and contraction of the grinding machine are reduced or eliminated. The dresser is angularly adjustable to accommodate the pitch angle of the grinding wheel during thread grinding operations.

15 Claims, 3 Drawing Sheets

GRINDING WHEEL DRESSER

BACKGROUND OF THE INVENTION

1. Field of the Invention

This invention relates to dressers used to shape the surface of a grinding wheel on a grinding machine to a very high degree of accuracy. More particularly, the invention relates to a grinding wheel dresser construction that minimizes the effect of temperature variations on the accuracy of the dressing operation.

2. Description of Related Art

Precision grinding machines use a grinding wheel to accurately grind a workpiece to a desired final shape and size. As the grinding wheel is used, it slowly wears away, decreasing the accuracy of the final ground workpiece as a result of changes in both the shape of the surface and the diameter of the grinding wheel.

In order to achieve the desired precision for the final piece, the grinding wheel must be periodically reshaped and resized or "dressed" with a device known as a grinding wheel dresser. In most modern grinding machines the dresser has a dressing wheel, rotating about a dressing wheel axis, having a dressing surface coated with industrial diamond. The grinding wheel, rotating about a grinding wheel axis, is moved under the command of a numerical control unit into a known position that brings the surface of the grinding wheel into contact with the rotating dressing wheel.

As the grinding wheel and the dressing wheel contact one another (in the dressing contact region), the relative motion of the two wheels causes the diamond surface of the dressing wheel to remove a layer of grit from the surface of the grinding wheel, reshaping and truing its surface. The dressing wheel, due to its surface coating of diamond, is much harder than the grinding wheel and does not significantly change either its surface shape or its size when the grinding wheel is dressed.

Except where otherwise clear from the context, the term "surface shape" when used in connection with the grinding wheel and the dressing wheel, principally refers to the shape of the wheel at the perimeter of the wheel, not to the diameter of the wheel. Stated differently, this is the curve defined by the intersection between a plane through the axis of rotation of the wheel and the perimeter of the wheel. This is essentially the same as the curve formed by the points of contact between the grinding wheel and the dresser during the dressing operation. Thus the "shape" of the grinding wheel can be maintained by the dresser even as the diameter or size of the wheel is reduced.

At the conclusion of the dressing operation the surface shape of the grinding wheel has been brought back into the original shape, but the diameter of the grinding wheel has been slightly reduced. The software operating the numerically controlled position of the grinding wheel knows the amount of reduction because it knows the position of both the dressing wheel and the grinding wheel during the dressing operation. The reduction in the diameter of the grinding wheel is accounted for in subsequent grinding operations so that the accuracy of each workpiece being ground is maintained.

The accuracy of the subsequent grinding operation, however, depends critically upon the accuracy to which the size of the grinding wheel is known after the dressing operation. Although the surface shape of the grinding wheel is set solely by the surface shape of the dressing wheel, the size of the grinding wheel depends upon the distance between the two wheels and upon the numerical control program's knowledge about the relative location of the two wheels. Any inaccuracy in the location of the dressing contact region relative to the workpiece surface to be ground results in a mistake in the size of the grinding wheel. In turn, this inaccuracy is transferred to the workpiece during the next grinding operation.

One important source of error in sizing the grinding wheel is thermal expansion and contraction of the grinding machine to which both the grinding wheel and the dresser are attached. If the grinding machine is heated by ambient temperature increases or waste heat from motors and electronics, etc. during the grinding operation, the grinding machine will expand slightly. This expansion changes the relative positions of the dressing wheel and the grinding wheel resulting in corresponding changes in the diameter of the grinding wheel and errors in the size of the workpiece produced.

As the distance between the workpiece surface and the dressing contact region increases, the distance over which the thermal size change acts is increased. This increases the size errors in the dressing of the grinding wheel. Ideally, one would like to have the dressing contact region at the same location as the grinding contact region so that the grinding wheel was reshaped at the same location as the wheel would be used during grinding.

Unfortunately, this would result in the dresser being mounted where the workpiece must be located. The conventional position for the dresser has been to mount the dresser on the opposite side of the grinding wheel from the workpiece so that it is clear of the working area and yet still has access to the grinding wheel surface.

In this configuration the surface of the grinding wheel is dressed on the back side of the grinding wheel, positioning the dressing contact region at a point 180 degrees from the front side of the wheel where the grinding contact region between the wheel and the workpiece is located. However, this placement results in locating the dressing contact region much farther from the axis of rotation of the workpiece than the grinding contact region. The disparity in this distance magnifies the thermal expansion errors when dressing the grinding wheel.

A principal object of the present invention is to avoid thermal expansion errors by locating the dressing wheel and the dressing contact region such that thermal expansion errors are eliminated or substantially reduced.

SUMMARY OF THE INVENTION

The above and other objects, which will be apparent to those skilled in the art, are achieved in the present invention which is directed to a dresser adapted for mounting on a grinding machine wherein the dressing contact region is located at about the same distance from the workpiece axis as is the grinding contact region. Preferably the location of the dressing contact region is between the grinding wheel axis and the workpiece axis. By locating the dressing contact region in this area, the effects of thermal expansion and contraction are substantially eliminated as the distance over which the expansion/contraction acts is reduced.

This is achieved in the preferred design shown here by using a ring-shaped dressing wheel having a central opening through which the workpiece axis and the tailstock of the grinding machine can project. This allows the dresser to be positioned on the same side of the grinding wheel as the workpiece with the dressing contact region between the workpiece axis and the grinding wheel axis.

The dressing wheel is mounted to a dresser body via a precision bearing and is rotated by a drive motor which is also mounted to the dresser body. The dresser body is mounted to the grinding machine via a base which in the most highly preferred embodiment is angularly adjustable. This permits the dresser wheel axis to be aligned with the grinding wheel axis when the grinding wheel is used to grind threads on a threaded workpiece. In an operation such as this, the axis of the grinding wheel is turned to match the helix or pitch angle of the threads to be ground. The angular adjustment of the dresser allows the dresser wheel axis to be turned to the same pitch angle as the grinding wheel axis so that the two are in alignment when the grinding wheel is dressed.

The angular adjustment is provided by constructing the body of the dresser with three portions: a dresser mount portion, a motor mount portion and a shaft connecting the dresser mount portion to the motor mount portion. The dressing wheel is mounted on the dresser mount portion of the body and the drive motor is mounted on the motor mount portion. The shaft connecting these two portions is clamped in a split block which may be loosened to allow the shaft to rotate to the desired pitch angle and then clamped.

BRIEF DESCRIPTION OF THE DRAWINGS

For a fuller understanding of the invention, reference should be made to the following description taken in connection with the accompanying drawings, in which.

DESCRIPTION OF THE PREFERRED EMBODIMENT

Figure 1:
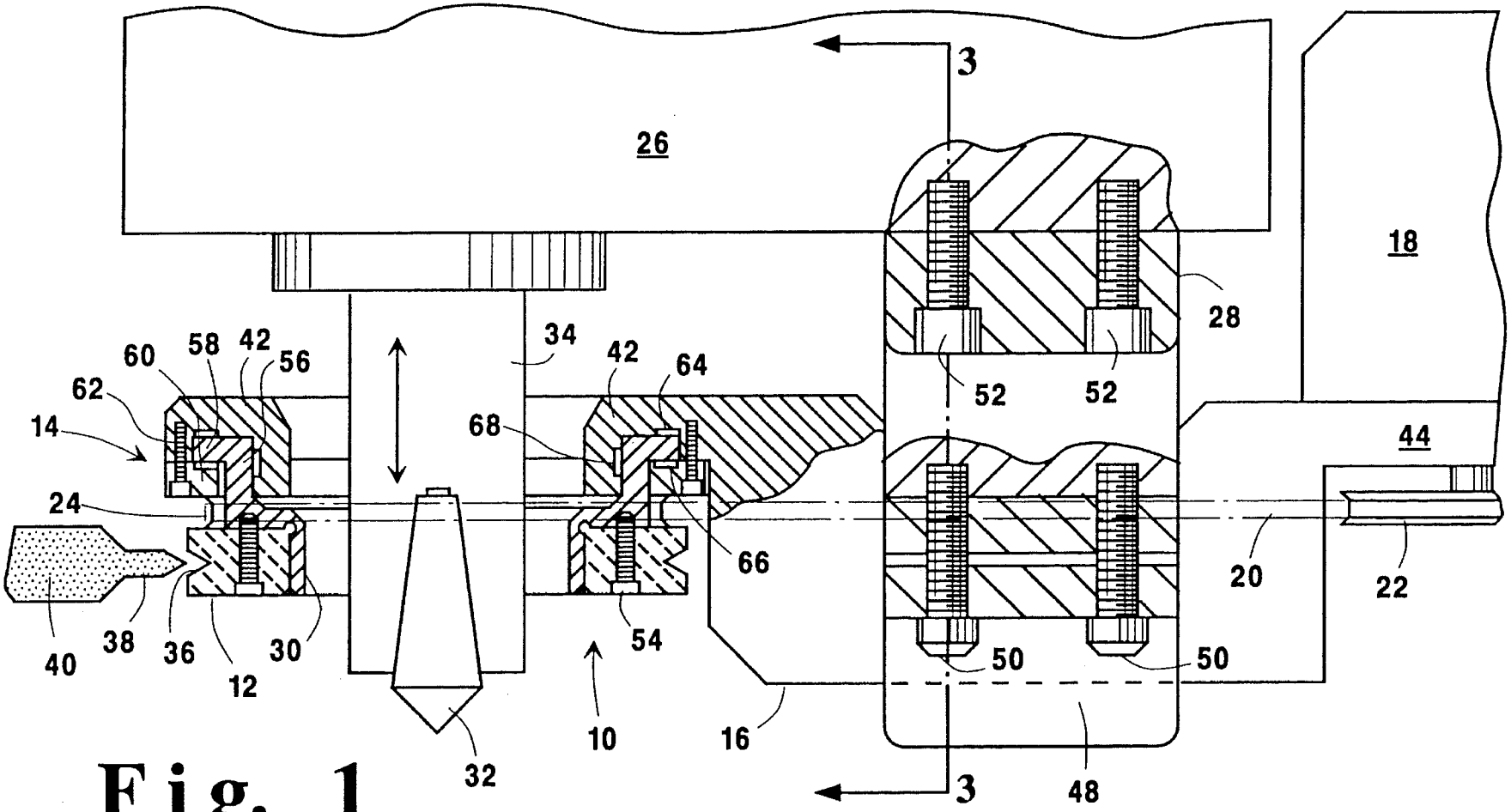
FIG. 1 is a top plan view, partly in cross section, of a dresser in accordance with the present invention, shown mounted on a grinding machine, only a portion of the grinding machine and a portion of the grinding wheel being shown.

In describing the preferred embodiment of the present invention, reference will be made herein to FIGS. 1–3 of the drawings in which like numerals refer to like features of the invention. Features of the invention are not necessarily shown to scale in the drawings.

Figure 2:
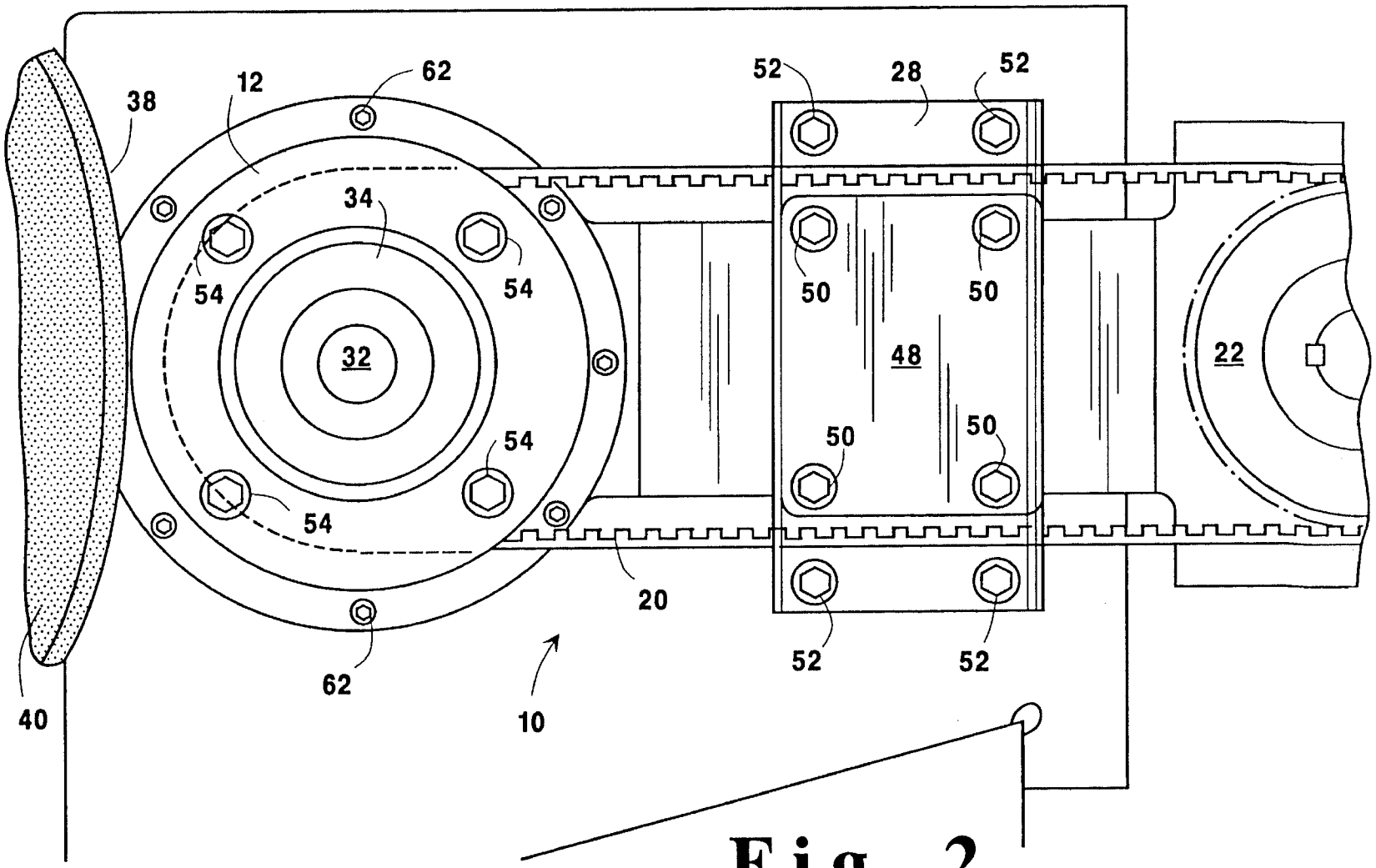
FIG. 2 is a front elevational view of the dresser of the invention seen in FIG. 1 looking towards the tailstock of the grinding machine.
Figure 3:
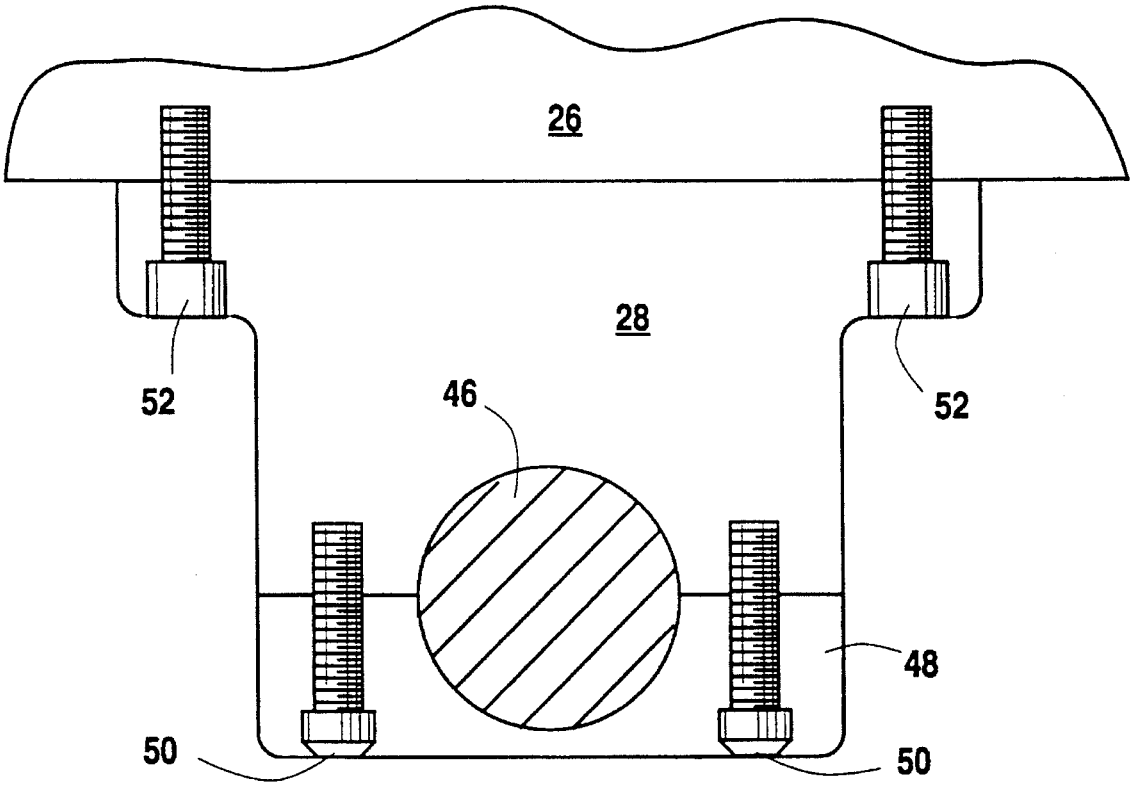
FIG. 3 is a cross sectional view along the line 3—3 in FIG. 1 showing a portion of the dresser of the present invention that includes the split block and angularly adjustable shaft mounting arrangement.

Referring first to FIGS. 1 and 2, the dresser, generally indicated by reference numeral 10, comprises a dressing wheel 12 rotationally mounted by a precision bearing 14 to a dresser body 16 and rotationally driven by a drive motor 18 via a drive belt 20 which connects the drive motor sheave 22 to the dresser wheel sheave 24.

The dresser body 16 is mounted to the grinding machine 26 through a split block base which captures a shaft 46, forming part of the dresser body 16. This mounting permits the body 16 to be rotated about the shaft to angularly adjust the axis of the dressing wheel to match the angle of the axis of the grinding wheel as needed in thread grinding operations. The dressing wheel 12 is ring-shaped having a central opening 30 with a diameter larger than tailstock 32 of the grinding machine 26.

The tailstock 32 is shown mounted in a tailstock ram 34 which is part of the grinding machine. The ram is retractable and extendible to permit new workpieces to be rapidly positioned between the tailstock and the headstock (not shown) of the grinding machine. The opening 30 will be selected to permit the operation of the tailstock for the particular grinding machine to which the dresser will be attached. Although the normal mounting is expected to be in the vicinity of the tailstock, some grinding machines may permit mounting near the headstock, and consequently the term "tailstock" as used herein should be understood to include the headstock whenever the design of the grinding machine is such that mounting near the headstock is feasible.

As shown in FIG. 1, the surface of the dressing wheel 12 has a notch 36 which has the same cross sectional shape as a thread to be ground on the workpiece. The inwardly directed V-shaped notch 36 on the surface of the dressing wheel 12 is the opposite of the shape of the outwardly directed V-shaped thread grinding surface 38 on grinding wheel 40. The dressing wheel 12 is preferably coated or impregnated with a layer of industrial diamond grinding material so that the grinding wheel 40 may be dressed without significantly altering the shape or size of the dressing wheel 12.

The industrial diamond is applied at least in the notch 36. The points of contact between notch 36 and thread cutting portion 38 define the dressing contact region which is located directly between the workpiece axis and the grinding wheel axis.

The central opening 30 defines a ring-shaped dressing wheel 12 and permits the dressing wheel to be located on the same side of the grinding wheel axis as the workpiece without interfering with the workpiece, the grinding wheel or normal operation of the grinding machine. Although the ring construction for the dressing wheel is preferred, in some applications it may be possible to use a very small dressing wheel located between the grinding wheel and the tailstock at about the same distance from the workpiece axis as the normal grinding contact region.

Alternatively, particularly where the grinding wheel 40 will have a flat grinding surface, it may be possible for flat dressing disks or plates to be positioned to present a dressing surface between the workpiece axis and the grinding wheel axis or at about the same distance from the workpiece axis as the normal grinding contact region. These and other embodiments that position the dressing contact region in the described location between the grinding wheel and the tailstock are also contemplated in the present invention.

Whenever the grinding machine is used to grind threads, a grinding wheel having a thread cutting portion 38, such as that shown in FIG. 1, will be used. In such cases, the axis of the grinding wheel 40 must be turned so that it is no longer parallel to the workpiece axis (as shown in FIG. 1) but, instead, is turned to an angle which corresponds to the helix angle or pitch angle of the threads being cut. For clarity in the drawings, this helix or pitch angle has not been shown.

In order to properly dress the surface of the grinding wheel 40, the axis of rotation of the dressing wheel must be parallel to the axis of rotation of the grinding wheel. This pitch angle adjustment is provided by the way in which the dresser body 16 is mounted to the grinding machine. The dressing wheel 12 is mounted to a dresser mount portion 42 of the dresser body 16 and the drive motor 18 is mounted on a motor mount portion 44. The dresser mount portion is connected to the motor mount portion by a shaft 46, seen in cross section in FIG. 3. The shaft 46 is rotationally captured in the split block of FIG. 3 between the split block base 28 and the split block cap 48.

After the dresser body 16 and shaft 46 are rotated to the appropriate pitch angle to match the pitch of the grinding wheel, four screws 50 are tightened to clamp the shaft between the split block cap 48 and the split block base 28. The base 28 is mounted to the grinding machine 26 via bolts 52.

In the preferred design, when a screw thread is not being ground, the dressing wheel axis is aligned with the workpiece axis and the workpiece and dressing wheel are coaxially mounted. When a screw thread is being ground, the two axes are divergent by the pitch angle of the threads as the angularly adjustable mount is changed.

The dressing wheel 12 is mounted to the dresser mount portion 42 with any suitable high precision bearing that lets the dressing wheel spin while holding it accurately in position. The bearing must be sufficiently low friction to permit the dressing wheel to be driven by the motor and yet accurate and strong enough to hold the location of the dressing wheel to a high degree of precision even while the grinding wheel is in contact with it. In the preferred embodiment this high precision bearing is a hydrostatic bearing which has a large bearing surface. Roller or ball bearings may also be used if they are constructed to the necessary tolerances for the dressing operations to be performed.

The dressing wheel 12 is bolted with bolts 54 to a bearing ring 56 having a lip portion 58 which is captured between the dresser mount 42 and a clamping ring 60 bolted to the dresser mount portion 42 with bolts 62.

The hydrostatic bearing is conventionally formed. The lip portion 58 has a slight clearance relative to the ring 60 and the dresser mount portion 42, and the bearing is formed by applying lubricant under pressure (the lubricant pump and lubricant fittings are not shown) to the three (3) bearing pockets 64, 66 and 68 located on either side of the lip 58 and inside the ring 56.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

Thus, having described the invention, what is claimed is:

1. A dresser adapted for mounting on a grinding machine having a tailstock defining a workpiece axis, the dresser comprising:

a body;

a ring-shaped dressing wheel having a central opening with a diameter larger than the tailstock of the grinding machine;

a precision bearing rotationally mounting the dressing wheel to the body;

a drive motor connected to rotate the dressing wheel on the precision bearing about a dressing wheel axis; and a base connected to the body and the grinding machine, mounting the body of the dresser with the tailstock of the grinding machine projecting through the central opening of the dressing wheel, the body being angularly adjustable relative to the base to rotate the dressing wheel axis to a desired angle relative to the workpiece axis.

2. A dresser according to claim 1 wherein the base includes a split block and the body includes a shaft mounted in the split block.

3. A dresser according to claim 2 wherein the body includes a dresser mount portion having the dressing wheel mounted thereon and a motor mount portion having the drive motor mounted thereon, the dresser mount portion and the motor mount portion being connected together by the shaft with the motor and the dressing wheel on opposite sides of the split block.

4. A dresser according to claim 1 wherein the precision bearing is a hydrostatic bearing.

5. A dresser according to claim 1 wherein the drive motor rotates the dressing wheel via a drive belt.

6. A dresser adapted for mounting on a grinding machine having a grinding wheel on a grinding wheel axis and a workpiece on a workpiece axis, the dresser comprising:

a body;

a dressing wheel mounted on the body, the dressing wheel having a perimeter defining a dressing contact region relative to the body along a portion of the perimeter where the grinding wheel contacts the dressing wheel when the shape of the grinding wheel is dressed; and a base connected to the body and the grinding machine, mounting the body on the grinding machine with the dressing contact region positioned between the workpiece axis and the grinding wheel axis, the base including a split block, and the body including a shaft mounted in the split block to make the body angularly adjustable relative to the base.

7. A dresser according to claim 6 wherein the body includes a dresser mount portion having the dressing wheel mounted thereon and a motor mount portion having a drive motor mounted thereon, the dresser mount portion and the motor mount portion being connected together by the shaft with the motor and the dressing wheel on opposite sides of the split block.

8. A dresser according to claim 7 wherein the drive motor rotates the dressing wheel via a drive belt.

9. A dresser according to claim 6 wherein the dressing wheel is rotationally mounted to the body by a precision bearing.

10. A dresser according to claim 9 wherein the precision bearing is a hydrostatic bearing.

11. A grinding machine comprising:

a grinding wheel rotationally mounted about a grinding wheel axis, the grinding wheel being movable from a grinding position for grinding a workpiece to a dressing position for dressing the shape of the grinding wheel;

a tailstock defining a workpiece axis; and a dresser comprising:

a body;

a ring-shaped dressing wheel mounted on the body for rotation about a dressing wheel axis, the dressing wheel having a central opening with a diameter through which the tailstock can project without contacting the dressing wheel, the dressing wheel contacting the grinding wheel in a dressing contact region when the grinding wheel is in the dressing position;

a precision bearing rotationally mounting the dressing wheel to the body;

a drive motor connected to rotate the dressing wheel on the precision bearing; and a base mounting the body to the grinding machine with the tailstock projecting through the central opening of the dressing wheel and the dressing contact region located between the workpiece axis and the grinding wheel axis, the body being angularly adjustable relative to the base to rotate the dressing wheel axis to a desired angle relative to the workpiece axis.

12. A dresser according to claim 11 wherein the base includes a split block and the body includes a shaft mounted in the split block.

13. A dresser according to claim 12 wherein the body includes a dresser mount portion having the dressing wheel mounted thereon and a motor mount portion having the drive motor mounted thereon, the dresser mount portion and the motor mount portion being connected together by the shaft with the motor and the dressing wheel on opposite sides of the split block.

14. A dresser according to claim 11 wherein the precision bearing is a hydrostatic bearing.

15. A dresser according to claim 11 wherein the drive motor rotates the dressing wheel via a drive belt.

* * * * *